US006167673B1

(12) United States Patent
Fournier

(10) Patent No.: US 6,167,673 B1
(45) Date of Patent: Jan. 2, 2001

(54) UTILITY POLE

(76) Inventor: Paul W. Fournier, 1302 Robincrest, Mascouche, Quebec (CA), J7L 3S4

( * ) Notice: Under 35 U.S.C. 154(b), the term of this patent shall be extended for 0 days.

(21) Appl. No.: 09/272,358

(22) Filed: Mar. 19, 1999

(30) Foreign Application Priority Data

Mar. 19, 1998 (CA) ..... 2227436
May 11, 1998 (CA) ..... 2235237

(51) Int. Cl.[7] ..... E04C 3/30

(52) U.S. Cl. ..... 52/726.4; 52/723.1; 52/736.3; 52/726.1; 52/736.2; 52/736.1; 52/736.4; 52/737.4; 52/737.5; 52/738.1

(58) Field of Search ..... 52/726.4, 723.1, 52/736.3, 726.1, 736.2, 736.1, 736.4, 737.4, 737.5, 738.1, 740.6; 403/292, 334, 335

(56) References Cited

U.S. PATENT DOCUMENTS

| | | | | |
|---|---|---|---|---|
| 839,272 | * | 12/1906 | Crow | 52/697 |
| 1,158,415 | * | 10/1915 | Boyle | 285/290.3 |
| 1,446,239 | * | 2/1923 | Yumura | 362/431 |
| 3,564,804 | * | 2/1971 | Archer et al. | 52/745.17 |
| 3,865,498 | * | 2/1975 | Okuto et al. | 403/292 |
| 3,958,381 | * | 5/1976 | Meyer | 52/303 |
| 3,991,532 | * | 11/1976 | Buxbom | 52/297 |
| 4,949,525 | * | 8/1990 | Weaver | 52/736.1 |
| 5,090,837 | * | 2/1992 | Mower | 403/334 |
| 5,222,344 | * | 6/1993 | Johnson | 52/736.4 |
| 5,339,594 | * | 8/1994 | Ventura-Berti | 52/736.3 |
| 5,513,477 | | 5/1996 | Farber . | |
| 5,675,956 | * | 10/1997 | Nevin | 52/726.1 |

FOREIGN PATENT DOCUMENTS

| | | |
|---|---|---|
| 36 36078 A1 | 4/1988 | (DE) . |
| 0 203 857 A1 | 12/1986 | (EP) . |
| 2 619 749 A1 | 3/1989 | (FR) . |

* cited by examiner

*Primary Examiner*—Christopher T. Kent
*Assistant Examiner*—Jennifer I. Thissell
(74) *Attorney, Agent, or Firm*—Swabey Ogilvy Renault; Michel Sofia

(57) ABSTRACT

A utility pole comprises an inner structure disposed within an envelop formed of a different material than that of the inner structure, thereby enabling the combination of the qualities inherent to both materials in a single utility pole. The utility pole may be of a modular construction for allowing equipment and accessories to be integrated to the utility pole. For instance, a transformer may be added between two adjacent sections of the inner structure of the utility pole. A distribution system may be provided in the base of the utility pole for allowing some utility lines to be concealed within the utility pole and the soil

36 Claims, 5 Drawing Sheets

UTILITY POLE

BACKGROUND OF THE INVENTION

1. Field of the Invention

The present invention relates to poles and, more particularly, to a pole structure suitable for supporting equipment, such as utility lines, transformers, and luminaires.

2. Description of the Prior Art

Conventional poles used for supporting electric equipment, such as transformers and utility lines carrying electrical power, cable television signals or telephone signals, are typically made of wood. Since wood is susceptible to insect infestation and rot, a preservative, such as creosote, must be applied under pressure to the wood poles. Such a preservative is toxic for the environment in general and, particularly, for humans.

Furthermore, trees suitable for use as utility poles have become less available and have become a limited resource to be carefully conserved.

Accordingly, it has been proposed to use metal poles as an alternative to wood poles, but such metal poles have disadvantages. For instance, the conductivity of metal poles represents a source of danger and necessitates costly methods of insulation. Moreover, metal poles are subject to corrosion and erosion.

It has also been proposed to replace existing wood poles by unitary concrete poles. This approach has several disadvantages in that the pole, for instance, would have to be very bulky and heavy to sustain typical loads encountered. This also prevents electrical equipment and accessories from being integrated in the pole.

Finally, it has been found that there is a need for a utility pole which is adapted to conceal some of the utility lines in order to improve the integration of utility poles in their environment.

SUMMARY OF THE INVENTION

It is therefore an aim of the present invention to provide an improved utility pole mounting structure.

It is also an aim of the present invention to provide a utility pole which is adapted to withstand loads applied thereto, while being resistant to corrosive environmental agents.

It is further aim of the present invention to provide a utility pole which is safe for the environment.

Therefore, in accordance with the present invention, there is provided a utility pole, comprising an inner structure disposed within an envelope, said inner structure being composed of a first material providing primary load carrying strength, said envelope being composed of a second material providing secondary load carrying strength, said secondary load carrying strength being lesser than said primary load carrying strength, said inner structure being spaced from an inner surface of said envelope for allowing relative movements between said inner structure and said envelope, and load transferring means for partially transferring loads from said inner structure to said envelope.

According to a further general aspect of the present invention, there is provided a utility pole, comprising at least first, second and third pole sections having longitudinally interconnected end portions, said second pole section being disposed between said first and third pole sections and comprising a transformer means.

According to a further general aspect of the present invention, there is provided a utility pole comprising a hollow pole section supported on an axially extending inner pole structure, and cover means for enclosing said axially extending inner pole structure, said cover means and said axially extending inner pole structure defining a chamber therebetween for accommodating distributor means effective for connecting subscribers to service lines, said cover means being configured to allow authorized persons to have access to said chamber.

According to a further general aspect of the present invention, there is provided an accessory for use with a utility pole having at least one upper pole section resting on a lower pole section, said accessory comprising a sleeve portion adapted to fit enugly about an outer surface of the utility pole, and spacer means extending inwardly from an inner surface of said sleeve portion for engagement between said upper and lower pole sections.

According to a further general aspect of the present invention, there is provided a modular utility pole comprising a first pole section and a second pole section, said first pole section being provided at one end thereof with a projection extending axially from an inner periphery of a shoulder means, said shoulder means being adpated to bear against a surface surrounding an axially extending bore defined at one end of said second pole section for receiving said projection, said axially extending bore being delimited by an inner wall configured to cooperate with said projection to ensure that said first and second pole sections remain connected by gravity.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
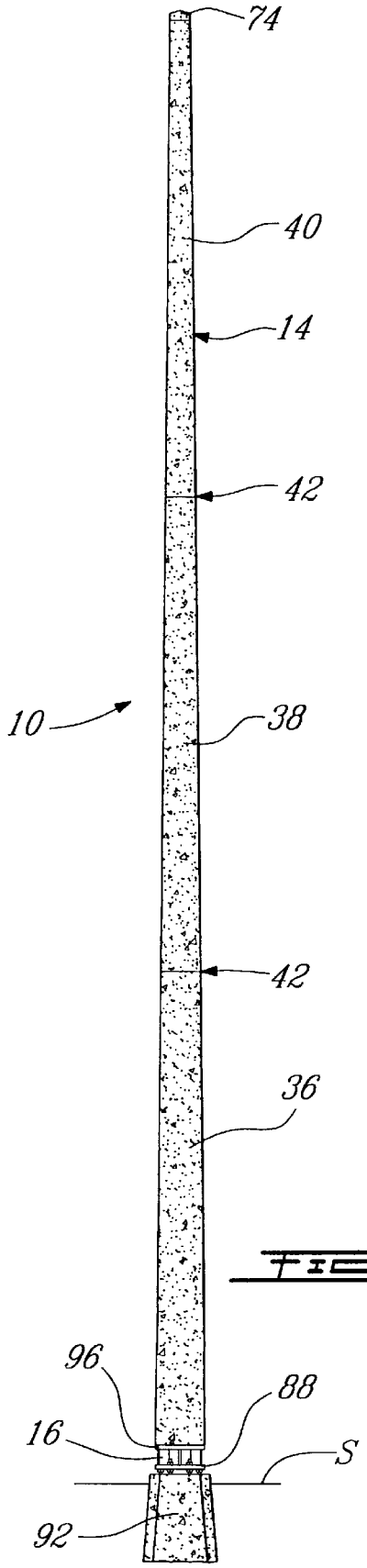
FIG. 1 is an elevational view of a pole structure in accordance with a first embodiment of the present invention.

Now referring to the drawings, and in particular to FIGS. 1 to 6, a utility pole embodying the elements of the present invention and generally designated by normal 10 will be described.

The utility pole 10, shown in FIG. 1, is particularly suited for supporting utility lines such as those carrying electrical power, cable television signals or telephone signals. The utility pole 10 may also be used for supporting at a certain height various elements, such as road signs, lamps and other types of accessories or electrical equipment.

Figure 2:
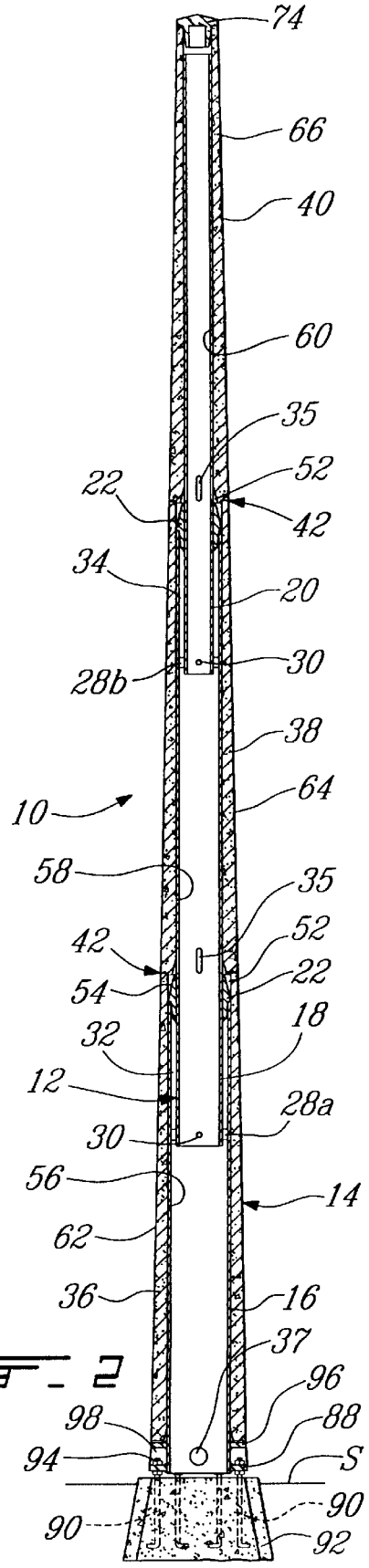
FIG. 2 is a vertical cross-sectional view of the pole structure of FIG. 1.

More specifically, as seen in FIG. 2, the utility pole 10 comprises an inner structure 12 concentrically disposed within an envelope 14. According to a first embodiment of the present invention, the inner structure 12 is made of galvanized steel, whereas the envelope 14 is formed of fibrous cement. Asbestos fibres are preferred as the main fibre component of the fibrous cement but other types of fibres or combination of fibres could be used. By forming the inner structure 12 and the envelope 14 of different materials, it becomes possible to combine the qualities inherent to each material in a single pole, while at the same time minimizing their respective drawbacks. For instance, the above described mixed composition contributes to improve the load carrying strength, the durability and the esthetic quality of the utility pole 10. The inner structure 12 provides the required load carrying strength and the envelope 14 provides a durable finish while at the same offering added strength. In the present case, the envelope 14 also insulates the inner structure 12 which is formed of a conductive material. However, it is understood that the inner structure 12 could be composed of a non-conductive material having sufficient load carrying capabilities, such as fiber/resin composite materials and some polymeric materials. Aluminum, as well as other metals, could also be used as an alternative structural material for the inner structure 12.

Other types of cement, such as composite cement, or concrete could also be used for the envelope 14. Moreover, other materials, such as polymeric materials, which are stable to light and to atmospheric agents, while offering sufficient structural rigidity, are also contemplated to form the envelope 14.

As seen in FIG. 2, the inner structure 12 is formed of telescopically mounted bottom, intermediate and top tubular inner sections or segments 16, 18 and 20. It is understood that more or less than three tubular inner segments could be provided according to the intended application.

The bottom tubular inner segment 16 has a larger diameter than that of the intermediate tubular segment 18 which in turn has a larger diameter than that of the top tubular inner segment 20.

As seen in FIG. 2, the intermediate and top tubular inner segments 18 and 10 are respectively supported on the bottom and intermediate tubular segments 16 and 18 by means of respective shoulder members 22.

Figure 4:
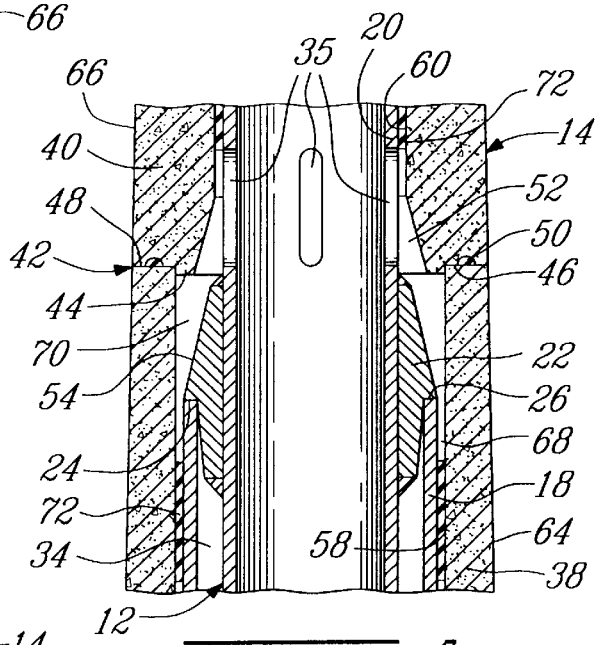
FIG. 4 is an enlarged cross-sectional view of a joint between two adjacent sections or segments of the pole structure.

FIG. 4 illustrates the details of the shoulder member 22 supporting the top tubular inner segment 20 on the intermediate tubular segment 18. More particularly, the shoulder member 22 is welded on the outer surface of the top tubular inner segment 20 proximate a bottom end portion thereof and defines a support surface 24 lying in a plane perpendicular to a longitudinal axis of the top tubular inner segment 20 to uniformly engage a top end surface 26 of the intermediate tubular inner segment 18.

As seen in FIG. 2, spacers 28*a* are provided between the bottom tubular inner segment 16 and the intermediate tubular inner segment 18 proximate a bottom end thereof. Similarly, spacers 28*b* are provided between the intermediate tubular inner segment 18 and the top tubular inner segment 20 proximate a bottom end thereof. The spacers 28*a* and 28*b* ensures coaxial alignment of the tubular inner segments 16, 18 and 20.

Bolts 30 may also be used to secure the intermediate tubular inner segment 18 to the bottom tubular inner segment 16 and the top tubular inner segment 20 to the intermediate tubular inner segment 18, as seen in FIG. 2.

It is also contemplated to fill the free space 32 defined between the bottom and intermediate 34 defined between the intermediate and top tubular inner segments 18 and 20 with a foam material to damper vibrations and reduce noises resulting from the metal to metal contact. For instance, an expansive material could be injected in the free spaces 32 and 34.

Furthermore, it is contemplated to provide anti-corrosion materials, e.g. a magnesium ring, especially in the free spaces 32 and 34, in order to protect the integrity of the inner structure 12.

As seen in FIGS. 2 and 4, longitudinally extending slots 35 may be defined in the tubular inner segments 16, 18 and 20 for allowing the passage of lines, as will be explained hereinafter. At least one hole 37 is also defined at the bottom end of the tubular inner segment 16 to provide access to the interior of the inner structure 12, thereby allowing power lines connected to an external source of power to extend within the utility pole 10. Accordingly, the utility pole 10 may serve, for instance, as a lamp post.

As seen in FIG. 2, the envelope 14 is constructed of a bottom tubular outer segment 36, an intermediate tubular outer segment 38 and a top tubular outer segment 40 mounted in an end-to-end relationship. However, it is understood that the envelope 14 could be composed of more or less than three tubular outer segments.

Joints 42 are provided for holding the intermediate tubular outer segment 38 on the bottom tubular outer segment 36 and the top tubular outer segment 40 on the intermediate tubular outer segment 38. FIG. 4 illustrates a typical construction of such joints 42.

More specifically, as seen in FIG. 4, the joint 42 formed at the interface of the intermediate and top tubular outer segments 38 and 40 includes a lip 44 projecting axially downwardly from an inner circumference of a bottom end of the top tubular outer segment 40. The lip 44 is integrally cast with the top tubular outer segment 40 and is configured to fit within the top end of the intermediate tubular outer segment 38. An annular supporting surface 46, lying in a plane perpendicular to a longitudinal axis of the top tubular outer segment 40 is defined about the root or bottom end of the lip 44 for evenly abutting the top end surface 48 of the intermediate tubular outer segment 38. As the lip 44 extends below the junction of the annular supporting surface 46 and the top end surface 48, it will prevent the top tubular outer segment 40, which bears firmly against the top end surface 48 of the intermediate tubular outer segment 38 due to its weight, from being disconnected from the intermediate tubular outer segment 38. Moreover, the lip 44 will also act as a draining surface to prevent condensate formed within the envelope 14 from flowing out of the utility pole 10 through the joint 42.

A circular groove may be defined in the annular supporting surface 46 of receiving a seal 50.

As seen in FIGS. 2 and 4, the intermediate and top tubular outer segments 38 and 40 each define an enlarged tapering passage 52 at a bottom end portion thereof to cooperate with an outer frustoconical surface 54 of the shoulder members 22 in order to provide added clearance and thus allow maximum relative axial movements between the inner structure 12 and the envelope 14.

Figure 5:
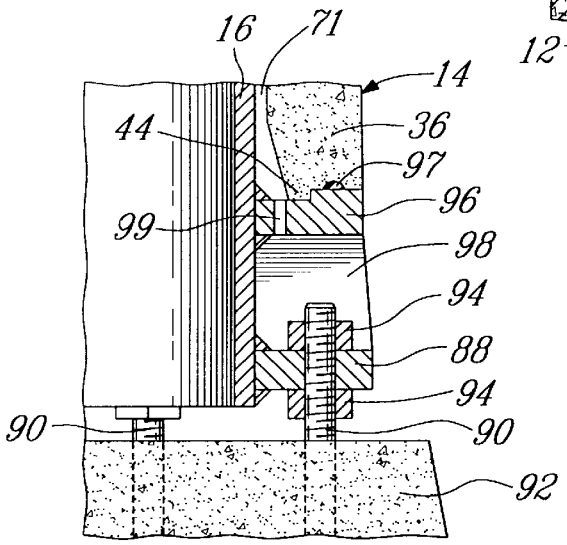
FIG. 5 is an enlarged cross-sectional view of a bottom portion of the pole structure, showing how the pole structure is anchored to a concrete base.
Figure 6:
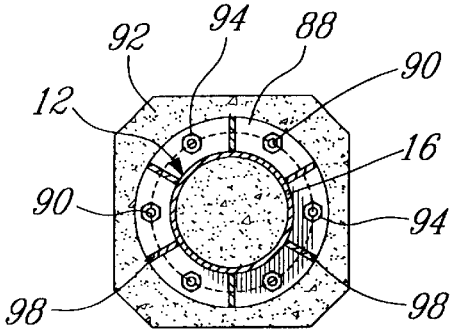
FIG. 6 is a top plan view of a bottom flange of the pole structure.

The bottom, intermediate and top tubular outer segments 36, 38 and 40 each have a cylindrical inner surface 56, 58, 60 and a frustoconical outer surface 62, 64, 66 tapering slightly from bottom to top. The outer surfaces 62, 64 and 66 cooperate to form a smooth and esthetic overall outer surface, whereas the inner cylindrical surfaces 56, 58 and 60 provide the required clearance for allowing lateral movements of the inner structure 12 in response to flexural loads applied thereto. More specifically, the inner diameters of the bottom, intermediate and top tubular outer segments 36, 38 and 40 are respectively larger than the outer diameters of the bottom, intermediate and top tubular inner segments 16, 18 and 20 so as to provide the required radial clearance between the inner structure 12 and the envelope 14 to thus ensure that the envelope 14, which is formed of a rigid material, will not interfere with the flexural movements of the inner structure 12, which is composed of a malleable material. The clearance 68 and 70 respectively defined between the intermediate tubular inner and outer segments 18 and 38 and the top tubular inner and outer segments 20 and 40 are shown in FIG. 4. The clearance 71 between the bottom tubular inner and outer segments 16 and 36 is illustrated in FIG. 5.

As seen in FIG. 4, an elastomeric material 72 may be disposed at selected locations between the inner structure 12 and the envelope 14 for ensuring gradual and partial transfer of loads therebetween. For instance, a neoprene foam could be injected in specific areas between the inner structure 12 and the envelope 14. Alternatively, a thick strip of a resilient polymeric material having an adhesive coating could be mounted in an axial or spiral fashion about the inner structure 12 to effect partial and controlled transfer of loads between the inner structure 12 and the envelope 14.

Figure 3:
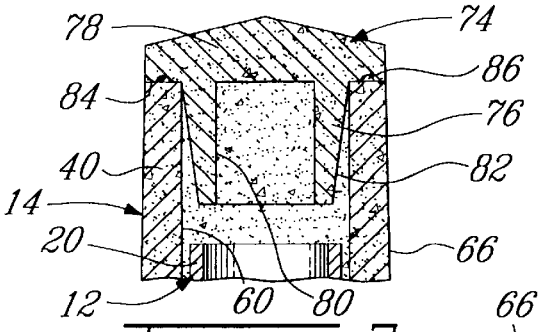
FIG. 3 is an enlarged cross-sectional view of a top end of the pole structure.

As seen in FIGS. 1 to 3, a cover 74 in the form of a plug may be installed at the top end of the top tubular outer segment 40 for preventing external agents, such as rain, from entering into the utility pole 10 when the same is not used to support utility lines. The cover 74 includes a hollow enlongated body 76 extending at right angle from an end wall 78. The hollow elongated body 76 as an inner cylindrical surface 80 and an outer frustoconical surface 82 tapering in a direction away from the end wall 78. The end wall 78 project radially outwardly of the hollow elongated body 76 so as to form a peripheral flange 84 configured to seat evenly on the top end surface of the top tubular outer segment 40. A circular groove 86 may be defined in the flange 84 to receive a seal.

As seen in FIGS. 1, 2, 5 and 6, an annular mounting plate 88 is welded on the outer surface of the bottom tubular inner segment 16. A plurality of circumferentially spaced-apart openings are defined in the mounting plate 88 for receiving threaded rods 90 extending upwardly from a concrete base 92 partly buried in the soil S. Nuts 94 are threadably engaged on the threaded rods 90 above and below the annular mounting plate 88 for securing the bottom tubular inner segment 16 to the concrete base 92.

An annular support plate 96 is welded on the outer surface of the bottom tubular inner segment 16 above the mounting plate 88 to support the envelope 14. Reinforcement plates 98 are uniformly circumferentially distributed between the annular mounting plate 88 and the reinforcement plate 98 to transfer loads therebetween. The support plate 96 defines an annular recess which is configured to receive the lip 44 extending from the bottom tubular outer segment 36. A neoprene joint 97 is provided between the bottom tubular outer segment 36 and the top surface of the annular support plate 96 to transfer loads therebetween. Bores 99 are defined through the support plate 96 for draining condensated liquid formed within the utility pole 10.

The utility pole 10 is assembled by first anchoring the bottom tubular inner segment 16 to the inner segment 18 is assembled to the bottom tubular inner segment 16 and the top tubular inner segment 20 is assembled to the intermediate tubular inner segment 18. Thereafter, the bottom, intermediate and top tubular outer segments 36, 38 and 40 are successively slid down about the inner structure 12.

Figure 7:
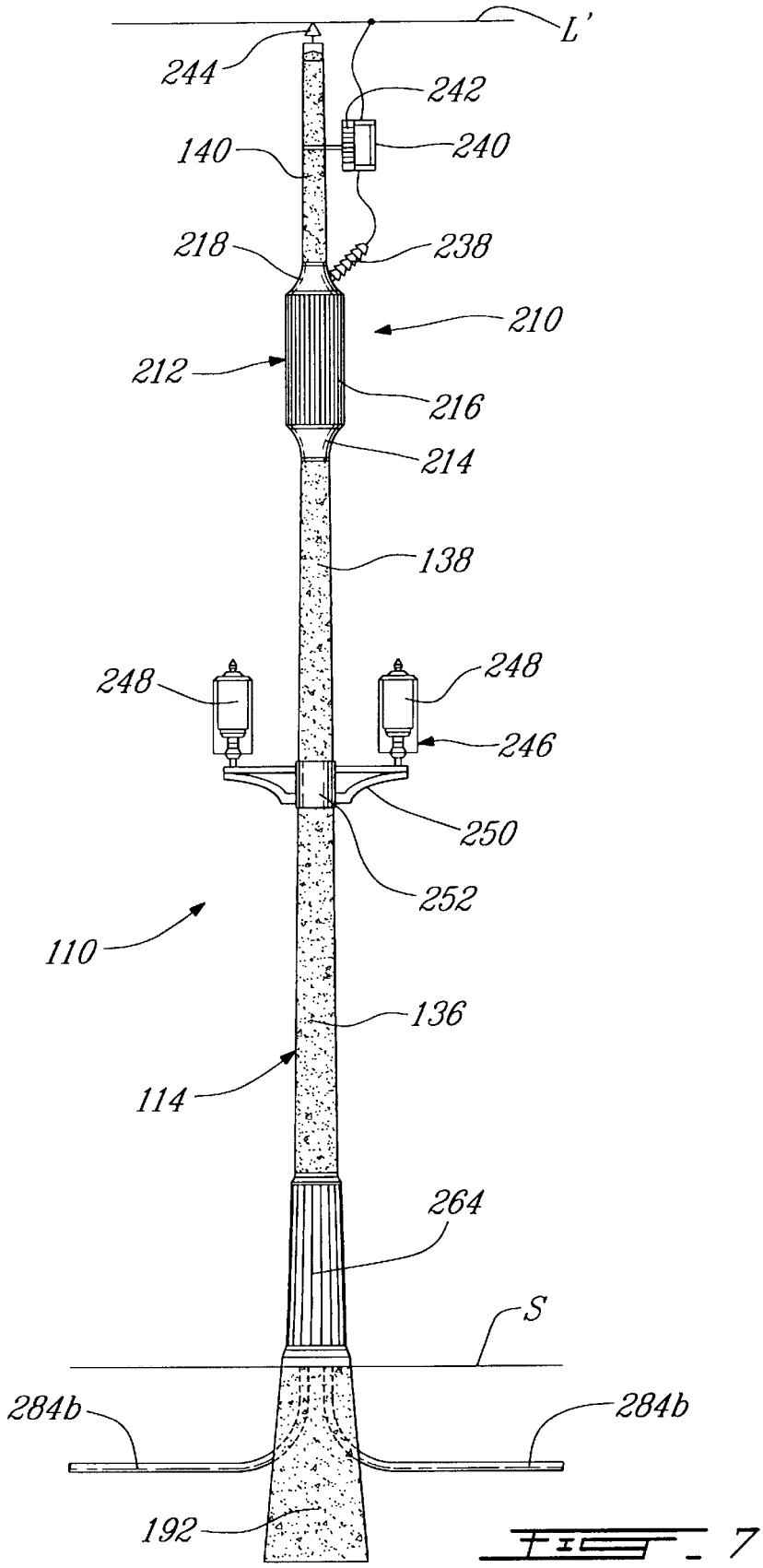
FIG. 7 is an elevational view of a modular structural pole having a transformer forming a part of an inner structure of the modular structural pole.

FIG. 7 illustrates another construction of a utility pole 110 in which a transformer 210 has been integrated as a section or segment of the inner structure 112. This permits to conceal the low tension distribution lines L (120/240 V) connected to the transformer 210 in the utility pole 110. Furthermore, by so mounting the transformer 210, the gravity load thereof is centered on the utility pole 110, thereby reducing the flexural loads. Finally, this contributes to enhance the esthetic quality of the utility pole 110.

Figure 8:
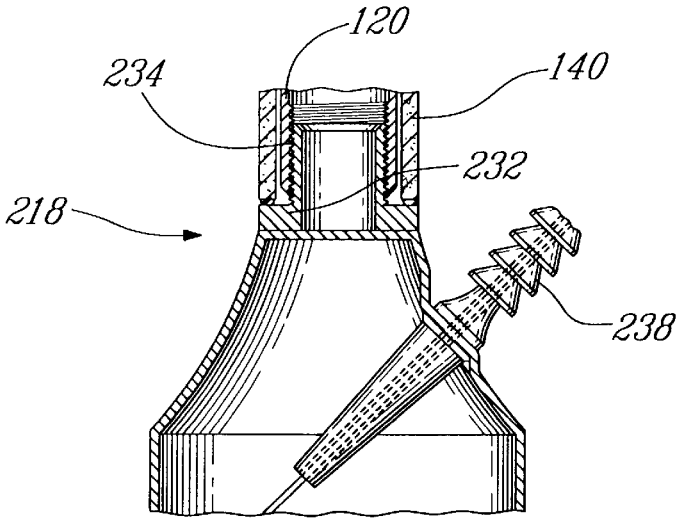
FIG. 8 is an enlarged cross-sectional view of an upper end of the transformer illustrating the connection thereof with a top segment of the inner structure.
Figure 9:
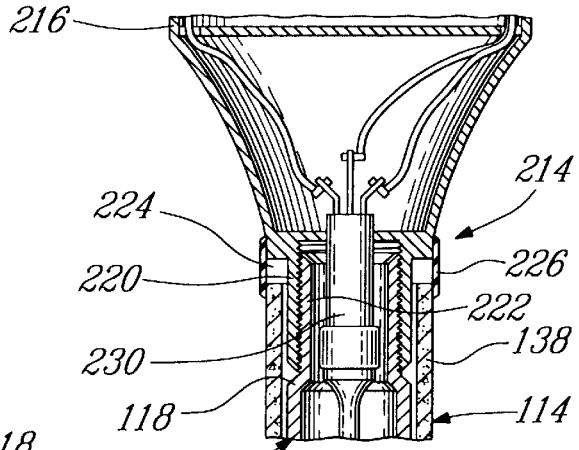
FIG. 9 is an enlarged cross-sectional view of a bottom end portion of the transformer illustrating the connection thereof with an intermediate segment of the inner structure.

As seen in FIGS. 7 to 9, the transformer 210 includes a structural casing 212 having a bottom end portion 214, an intermediate portion 216, which extends radially outwardly of the envelope 114, and a top end portion 218. The bottom end portion 214 includes an axially extending tubular projection 220 having internal threads for engagement with an externally threaded portion 222 provided at a top end area of the intermediate tubular inner segment 118. It is noted that the intermediate tubular inner segment 118 is otherwise similar to the intermediate tubular inner segment 18 illustrated in FIGS. 2 and 4. As seen in FIG. 9, an axial clearance 224 is provided between the intermediate portion 216 of the structural casing 212 and the top end surface of the intermediate tubular outer segment 138 of the envelope 114 to allow relative axial movements between the inner structure 112 and the envelope 114. A cover 226 is provided for preventing external agents from entering into the utility pole 110 via the clearance 224, while at the same time allowing relative movements between the inner structure 112 and the envelope 114.

The bottom end portion 214 of the casing 212 supports a connector 230, which is concentrically disposed relative to the longitudinal axis of the utility pole 110 so as to extend within the intermediate tubular inner segment 118, thereby allowing the low tension distribution lines L connected to the transformer 210 to be concealed within the inner structure 112.

As seen in FIG. 8, an externally threaded tubular member 232 is secured on the top end portion 218 of the structural casing 212 to threadably engage a bottom threaded end portion 234 of the top tubular inner segment 120. The externally threaded tubular member 232 is provided with an annular peripheral flange 236 upon which is seated the top tubular outer segment 140 of the envelope 114.

A bushing 238 extends through the casing 212 for allowing the transformer 210 to be connected to the medium tension distribution line L' supported at the end of the utility pole 110. A fuse 240 supported by a fuse holder 242 may be disposed between the transformer 210 and the medium tension line L', as is well known in the art.

The medium tension line L' is supported by the top tubular inner segment 120, which has been further modified to incorporate an insulator 244, as seen in FIG. 7.

It is understood that in the case of multiphase power distribution systems the top tubular segment 120 would be replaced by a similar top tubular segment, but configured to support the required number of lines. Moreover, more than one monophase transformer could be used to suit the application. In this case, the respective casings of the transformers would be distributed about a central pole section (not shown) mounted between two segments of the inner structure 112. The casings could be supported on a circular platform (not shown) secured to the central pole section.

The casing 212 of the transformer 210 is preferably made of steel but other materials having sufficient load carrying capabilities could be used.

It is also contemplated to assemble the transformer 210 to the inner structure 112 by means of tenons (not shown) provided at the top and bottom ends of the casing 212 for insertion into associated mortises (not shown) defined at the ends of adjacent inner tubular segments.

Figure 10:
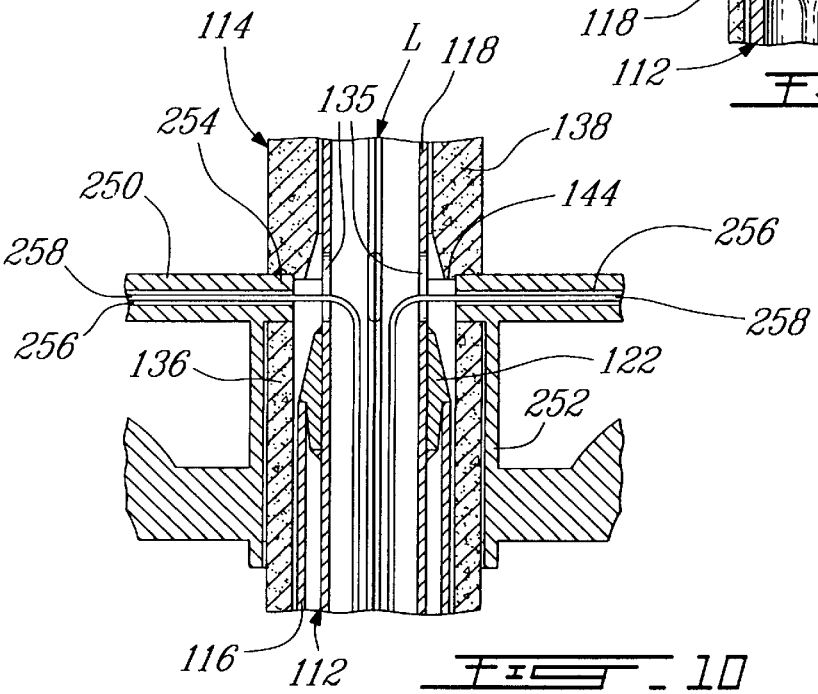
FIG. 10 is an enlarged cross-sectional view of an accessory mounted between two adjacent segments of an outer structure of the modular structural pole.

FIG. 10 illustrates how an accessory, such as a luminaire 246, is assembled to the utility pole 110. The luminaire 246 includes a pair of diametrically opposed electric lights 248 supported by a structure 250 extending radially outwardly from a central sleeve 252. The sleeve 252 is formed of two semi-circular symmetrical portions adapted to be assembled together about the envelope 114 by means of bolts or the like. The symmetrical portions are provided with lateral mounting flanges (not shown) through which the bolts are inserted to retain the two symmetrical portions together.

A collar 254 extends inwardly from an inner circumference of the sleeve 252 for insertion at the interface or junction of the bottom and intermediate tubular outer segments 136 and 138. The top and bottom surfaces of the mounting collar 254 extend in parallel planes, which are perpendicular to a longitudinal axis of the central sleeve 252, thereby ensuring that the intermediate tubular outer segment 138 be evenly supported relative to the bottom tubular outer segment 136.

The luminaire 246 is secured to the envelope 114 by firmly assembling the two symmetrical portions of the central sleeve 252 against the outer surface of the envelope 114 with the collar 254 extending between two adjacent tubular outer segments of the envelope 114. The bolts (not shown) which retain the two symmetrical portions forming the sleeve 252 provide for adjustment of the relative position of the symmetrical portions, thereby allowing the luminaire 246 to be assembled to envelope 114 of different outer diameters.

Linear radially extending passages 256 are defined through the structure 250 and the collar 254 for allowing the passage of electric cables 258 from the electric lights 248 into the inner structure 112 via the longitudinal slots 135 are necessary to allow the relative axial movements between the envelope 114 and inner structure 112 without imparting damages to the electric cables 258.

In order to completely conceal the low distribution lines L, the electrical cables 258 and other types of utility lines, a distribution chamber 260 is defined at the bottom of the utility pole 110. The distribution chamber 260 is configured to accommodate a distribution system (not shown) which is effective for connecting the subscribers to the low tension side of the transformer 210 and to other types of utility lines such as those used for carrying cable television signals or telephone signals.

More specifically, as shown in FIGS. 11 to 14, the distribution chamber 260 is formed by interrupting and replacing the inner tubular structure 112 and the envelope 114 of the utility pole 110 by an inner cruciform structure 262 surrounded by a cover 264.

Figure 12:
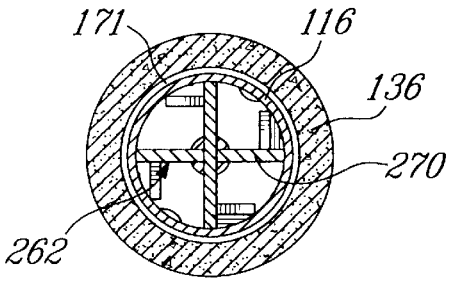
FIG. 12 is a cross-sectional view taken along line 12—12 of FIG. 11.
Figure 13:
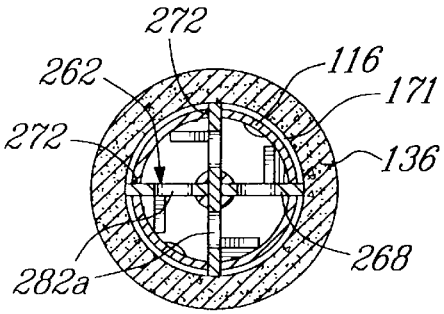
FIG. 13 is a cross-sectional view taken along line 13—13 of FIG. 11.
Figure 14:
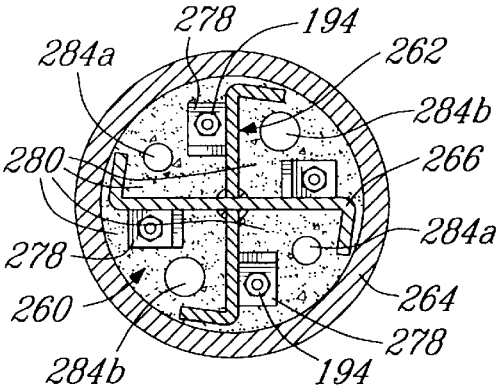
FIG. 14 is a cross-sectional view taken along line 14—14 of FIG. 11.
Figure 11:
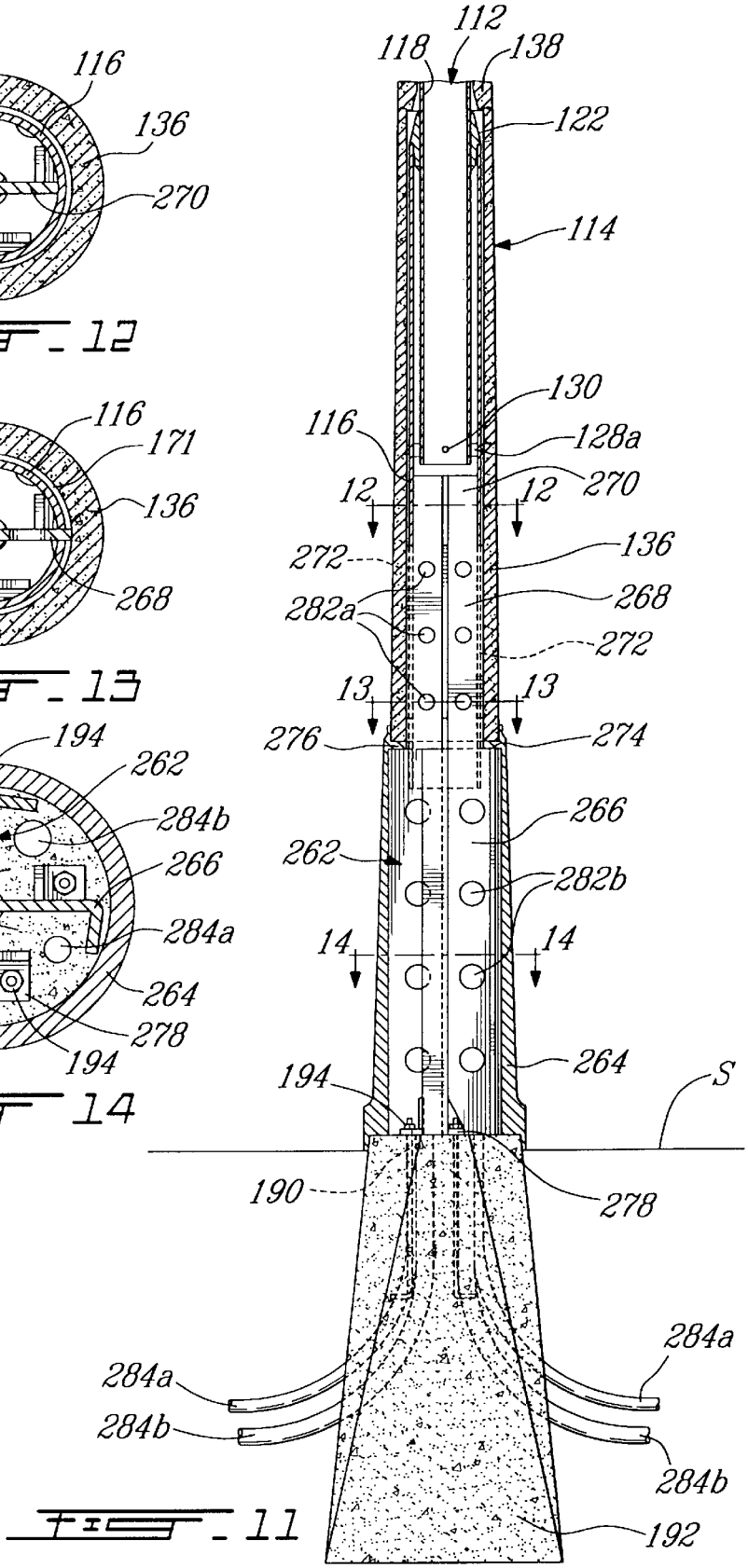
FIG. 11 is a vertical cross-sectional view of a bottom portion of the modular structural pole illustrating a distribution chamber thereof.

The cruciform structure 262 includes a bottom portion 266, an intermediate portion 268 and a top portion 270. As seen in FIG. 12, the top portion 270 extends within the bottom tubular inner segment 116 of the inner structure 112. As illustrated in FIG. 13, the intermediate portion 268 of the cruciform structure 262 extends radially outwardly of the bottom tubular inner segment 116 via four longitudinal cuts 272 defined in the cylindrical side wall of the bottom tubular inner segment 116. The cruciform structure 262 is welded to the outer surface of the bottom tubular inner segment 116 along the longitudinal cuts 272 thereof. As seen in FIGS. 11 and 14, the bottom portion 266 of the cruciform structure 262 extends radially outwardly of an inner circumference of the bottom tubular outer segment 136 and defines a shoulder 274 at the junction thereof with the intermediate portion 268. The ends of the branches forming the bottom portion 266 of the cruciform structure 262 are bent to provide added bearing surfaces (see FIG. 14). Four to eight L-shaped mounting plates 278 are welded to the bottom end of the cruciform structure 262 for anchoring the same to the concrete base 192 by means of the threaded rods 192 and the nuts 194.

the cover 264 is provided with an inwardly projecting collar 276 against a top surface of which is seated the bottom tubular outer segment 136. The loads applied to the collar 276 are transmitted to the cruciform structure 262 via the shoulder 274. The cover 264 includes two or (four) semi-cylindrical hinged panels (not shown) which can be opened to provide access to the four compartments 280 of the distribution chamber 260 formed by the cruciform structure 262 and the cover 264 itself. Each panel is provided with a lock (not shown) to prevent unauthorized persons to have access to the distribution chamber 260. According to a preferred embodiment of the present invention, the cover 264 is made of metal and, more particularly, of an alloy. However, it is understood that other materials such as, polymeric materials, could be used.

Power bars (not shown) can be mounted in the compartments 280 to connect subscribers to the low tension side of the transformer 210. The power bars will be electrically connected to each other and to the low distribution lines L via twist-lock connectors (not shown). In the event that utility lines carrying cable television signals and telephone signals are also concealed in the utility pole 110, two compartments 280 of the distribution chamber 260 could be placed at the disposal of telecommunication distributors. Two different sizes of openings 282*a* and 282*b* are defined in the cruciform structure 262 for receiving conduits through which the various distribution cables extend. The small openings 282*a* could be used for the telecommunication lines, whereas the large openings 282*b* could be used for the power distribution lines.

As seen in FIGS. 11 and 14, two different sizes of buried conduits 284*a* and 284*b* extend through the concrete base 192 into respective compartments 280 of the distribution chamber 260 for connecting the subscribers to the distribution or utility lines connected to the distribution system (not shown) placed in the distribution chamber 260 of the utility pole 110. The small conduits 284*a* can be used for the telecommunication distribution lines, whereas the large conduits 284*b* can be used for the power distribution lines.

It is noted that the distribution chamber 260 does not necessarily have to be disposed at the bottom of the utility pole 110.

Although the inner structure 12 and 112 have been herein described as being tubular, it is understood that solid inner structures could be used as well. Furthermore, the inner structures 12 and 112 may have, for instance, circular or polygonal cross-sections. It is also noted that I-shaped, T-shaped and other types of structural members could have been used as an alternative to the above described cruciform structure 262.

Finally, it is noted that the utility pole 10, 110 may be installed in the soil by extending the bottom tubular inner segment 16, 116 in the ground for direct burial. Then a ring is welded on the bottom tubular inner section 16, above the ground, to receive the bottom tubular outer segment 36, 136. Alternatively, the bottom tubular inner segment 16, 116 may be secured to a tubular steel tube (not shown) having a tapered bottom end planted in the soil.

What is claimed is:

1. A utility pole, comprising an inner structure disposed within an envelope, said inner structure being composed of a first material providing primary load carrying strength, said envelope being composed of a second material providing secondary load carrying strength, said secondary load carrying strength being smaller than said primary load carrying strength, a free space defined between said inner structure and said envelope for allowing relative movements between said inner structure and said envelope, and load transferring means for partially transferring loads from said inner structure to said envelope while allowing said inner structure and said envelope to move independently of one another.

2. A utility pole as defined in claim 1, wherein said load transferring means are resilient and disposed as selected locations between said inner structure and said envelope, and wherein said inner structure is elastically connected to said envelop.

3. A utility pole as defined in claim 1, wherein said inner surface of said envelope has a substantially uniform cross-section, and wherein said envelope has a frustoconical outer surface tapering towards a top end of said envelope.

4. A utility pole as defined in claim 1, wherein said inner structure is composed of a material selected from a group consisting of aluminum, steel, galvanized steel, fiber/resin composite materials, and polymeric materials, and wherein said envelope is composed of a material selected from a group consisting of concrete, composite cement, fibrous cement and polymeric materials.

5. A utility pole as defined in claim 1, wherein said envelope includes at least first and second hollow outer pole sections having longitudinally interconnected end portions.

6. A utility pole as defined in claim 5, wherein said first hollow outer pole section has a top end surface configured to mate with a bottom end surface of said second hollow outer pole section, gravity load of the second hollow outer pole section ensuring connection of said first and second hollow outer pole sections to transfer loads applied to said utility pole.

7. A utility pole as defined in claim 6, wherein said top end surface of said first hollow outer pole section and said bottom end surface of said second hollow outer pole section define an interface therebetween, said interface lying in a plane perpendicular to a longitudinal axis of said utility pole, and wherein a lip projects axially from an inner portion of one of said first and second hollow outer pole sections to a position past said interface.

8. A utility pole as defined in claim 7, wherein said lip extends downwardly from said inner portion of said bottom end surface of said second hollow outer pole section to a position below said interface, thereby preventing condensate liquid from flowing out of said envelope through said interface.

9. A utility pole as defined in claim 5, wherein said inner structure includes at least first and second inner pole sections having longitudinally interconnected end portions.

10. A utility pole as defined in claim 9, wherein said first and second inner pole sections are tubular, said first inner pole section having a larger cross-section than said second inner pole section, and wherein shoulder means are provided at a periphery of said second inner pole section for supporting said second inner pole section on said first inner pole section.

11. A utility pole as defined in claim 10, wherein a bottom end portion of said second inner pole section extends within said first inner pole section, and wherein spacer means are provided between said bottom end portion of said second inner pole section and said first inner pole section.

12. A utility pole as defined in claim 11, wherein fastening means are provided at said bottom end portion to secure said second inner pole section to said first inner pole section.

13. A utility pole as defined in claim 9, wherein a transformer means is mounted between said first and second inner pole sections so as to form a section of said inner structure, said first inner pole section defining a longitudinal passage for receiving distribution lines to be connected to said transformer means.

14. A utility pole as defined in claim 13, wherein said transformer means includes top and bottom end portions extending at least partly radially outwardly of said inner surface of said envelope, said bottom end portion of said transformer means being connected to a top end portion of said first inner pole section so as to define a free space axially between a top end surface of said first hollow outer pole section and said transformer means, thereby allowing relative movements between said inner structure and said envelope, said top end portion of said transformer means being connected to a bottom end portion of said second inner pole section and having a peripheral shoulder means for supporting said second hollow outer pole section.

15. A utility pole as defined in claim 14, wherein cover means are provided for preventing liquids from entering within said envelope through said free space.

16. A utility pole as defined in claim 5, further comprising an accessory mounted to said envelope, said accessory including a sleeve portion configured to be firmly mounted against an outer surface of said envelope at least at a junction of said first and second hollow outer pole sections, and spacer means extending inwardly from an inner surface of said sleeve portion for engagement between said first and second hollow outer pole sections.

17. A utility pole as defined in claim 16, wherein passage means are defined in said accessory for allowing line means to pass from said accessory through said spacer means into said envelope.

18. A utility pole as defined in claim 16, wherein said first and second hollow outer pole sections define an interface therebetween, said interface lying in a plane perpendicular to a longitudinal axis of said utility pole, and wherein said spacer means are configured to be inserted at said interface so as to maintain said first and second hollow outer pole sections at a uniform distance from one another.

19. A utility pole as defined in claim 1, wherein said inner structure includes at least one hollow inner pole section supported on an axially extending supporting body, said axially extending supporting body having shoulder means for supporting said envelope, and wherein cover means are provided for enclosing a portion of said axially extending supporting body located below said envelope, said cover means and said axially extending supporting body defining a chamber therebetween for accommodating distributor means effective for connecting subscribers to service lines, said cover means being configured to allow authorized persons to have access to said chamber.

20. A utility pole as defined in claim 19, wherein said axially extending supporting body has a cruciform cross-section.

21. A utility pole as defined in claim 20, wherein said axially extending supporting body has an upper end portion extending within said hollow inner pole section, an intermediate portion extending radially outwardly of said hollow inner pole section through longitudinal cuts defined in a lower end portion of said hollow inner pole section, and a lower end portion defining at a junction with said intermediate portion said shoulder means for supporting said envelope.

22. A utility pole, comprising at least first, second and third pole sections having longitudinally interconnected end portions, said second pole section being disposed between said first and third pole sections and comprising at least one electric transformer means mounted in line with said utility pole and integrated as a structural section thereof.

23. A utility pole as defined in claim 22, wherein said first pole section defines a passage for receiving line means to be connected to said electric transformer means.

24. A utility pole as defined in claim 23, wherein said first and third pole sections each include an inner structural member disposed within a hollow outer structural member having an inner surface which is spaced from an outer surface of said inner structural member for allowing relative movements therebetween, said inner structural member being composed of a first material providing primary load carrying strength, said hollow outer structural member being composed of a second material adpated to provide secondary load carrying strength, said secondary load carrying strength being smaller than said primary load carrying strength, and load transferring means for partially transferring loads from said inner structural member to said hollow outer structural member while allowing said inner structural member and said hollow outer structural member to move independently of one another.

25. A utility pole as defined in claim 24, wherein said electric transformer means is longitudinally mounted between respective inner structural members of said first and third pole sections.

26. A utility pole as defined in claim 25, wherein said electric transformer means includes top and bottom end portions extending at least partly radially outwardly of an inner periphery of said hollow outer structural members, said bottom end portion of said electric transformer means being connected to a top end portion of said inner structural member of said first pole section so as to define a free space axially between a top end surface of said hollow outer structural member of said first pole section and said electric transformer means, thereby allowing relative movements between said inner structural members and said hollow outer structural members, said top end portion of said electric transformer means being connected to a bottom end portion of said inner structural member of said third pole section and having a peripheral shoulder means for supporting said hollow outer structural member of said third pole section.

27. A utility pole as defined in claim 26, wherein cover means are provided for preventing liquids from entering within said envelope through said free space.

28. A utility pole comprising a hollow pole section supported at a bottom end thereof on an underlying axially extending inner pole structure, cover means for enclosing said axially extending inner pole structure, said cover means and said axially extending inner pole structure defining a chamber therebetween, and distributor means provided in said chamber for connecting subscribers to service lines, said cover means being configured to allow authorized persons to have access to said chamber.

29. A utility pole as defined in claim 28, wherein said axially extending inner pole structure includes an elongated supporting body.

30. A utility pole as defined in claim 29, wherein said elongated supporting body has an upper end portion extending within said hollow pole section, an intermediate portion extending radially outwardly of said hollow pole section through longitudinal cuts defined in a lower end portion of said hollow pole section, and a lower end portion extending under said hollow pole section.

31. A utility pole as defined in claim 30, wherein said elongated supporting body is cruciform in cross-section.

32. A utility pole as defined in claim 28, further comprising a base supporting said axially extending inner pole section, said base defining a plurality of conduits opening to said chamber, said conduit being adapted to extend into for allowing the service lines connected to said distributor means to be buried in the soil.

33. A accessory in combination with a utility pole having at least one upper pole section resting on a lower pole section, said accessory comprising a sleeve portion adapted to be contracted about an outer surface of the utility pole, and spacer means extending inwardly from an inner surface of said sleeve portion for engagement between said upper and lower pole sections.

34. An accessory as defined in claim 33, wherein the utility pole is hollow, and wherein said spacer means define passage means for allowing line means to pass from said accessory into the utility pole.

35. A modular utility pole comprising an upper pole section and a lower pole section, said upper pole section being provided at one end thereof with a projection extending axially downwardly from an inner portion of a shoulder means, said shoulder means bearing against a surface surrounding an axially extending bore defined at one end of said lower pole section for receiving said projection, said axially extending bore being delimited by an inner wall configured to cooperate with said projection to ensure that said upper and lower pole sections remain connected by gravity utility pole from flowing out of the pole at an interface of said upper and lower pole sections.

36. A modular utility pole as defined in claim 35, wherein said shoulder means and said surface surrounding said axially extending bore of said lower pole section extend in a plane perpendicular to a longitudinal axis of said modular utility pole, and wherein said upper pole section is mounted in coaxial alignment over said lower pole section with said projection extending downwardly into said axially extending bore.

* * * * *

UNITED STATES PATENT AND TRADEMARK OFFICE

CERTIFICATE OF CORRECTION

PATENT NO. : 6,167,673 B1
DATED : January 2, 2001
INVENTOR(S) : Paul W. Founier

It is certified that error appears in the above-identified patent and that said Letters Patent is hereby corrected as shown below:

Claim 35:
Kindly amend as follows:

35. A modular utility pole comprising an upper pole section and a lower pole section, said upper pole section being provided at one end thereof with a projection extending axially downwardly from an inner portion of a shoulder means, said shoulder means bearing against a surface surrounding an axially extending bore defined at one end of said lower pole section for receiving said projection, said axially extending bore being delimited by an inner wall configured to cooperate with said projection to ensure that said upper and lower pole sections remain connected by gravity while at the same time preventing liquid condensation formed within the modular utility pole from flowing out of the pole at an interface of said upper and lower pole sections.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*